US009375130B2

(12) United States Patent
Boyer

(10) Patent No.: US 9,375,130 B2
(45) Date of Patent: Jun. 28, 2016

(54) SPRAY CONTROL ASSEMBLY FOR A DISHWASHING APPLIANCE WITH DIRECTIONAL CONTROL FOR SPRAY ARMS

(71) Applicant: General Electric Company, Schenectady, NY (US)

(72) Inventor: Joel Charles Boyer, Louisville, KY (US)

(73) Assignee: General Electric Company, Schenectady, NY (US)

( * ) Notice: Subject to any disclaimer, the term of this patent is extended or adjusted under 35 U.S.C. 154(b) by 137 days.

(21) Appl. No.: 14/040,835

(22) Filed: Sep. 30, 2013

(65) Prior Publication Data

US 2015/0090306 A1 Apr. 2, 2015

(51) Int. Cl.
*A47L 15/23* (2006.01)
*A47L 15/42* (2006.01)

(52) U.S. Cl.
CPC ..... *A47L 15/4221* (2013.01); *A47L 15/23* (2013.01); *A47L 2401/20* (2013.01); *A47L 2501/03* (2013.01); *A47L 2501/20* (2013.01)

(58) Field of Classification Search
USPC ..... 134/174
See application file for complete search history.

(56) References Cited

U.S. PATENT DOCUMENTS

| | | | | |
|---|---|---|---|---|
| 3,496,949 | A | 2/1970 | Mercer | |
| 4,174,723 | A | 11/1979 | Long | |
| 4,266,565 | A | 5/1981 | Gurubatham | |
| 4,509,687 | A | 4/1985 | Cushing | |
| 6,357,460 | B1 * | 3/2002 | Bertsch | A47L 15/23 134/174 |
| 6,955,449 | B2 | 10/2005 | Martineau | |
| 6,964,877 | B2 | 11/2005 | Chen et al. | |
| 6,975,369 | B1 | 12/2005 | Burkholder | |
| 7,409,962 | B2 | 8/2008 | Welch | |
| D603,079 | S | 10/2009 | Toot et al. | |
| 7,633,055 | B2 | 12/2009 | Nall et al. | |
| 7,635,203 | B2 | 12/2009 | Weaver, Jr. et al. | |
| 7,635,869 | B2 | 12/2009 | Kolodin et al. | |
| 2007/0295361 | A1 * | 12/2007 | Thiyagarajan | A47L 15/23 134/18 |
| 2010/0043825 | A1 * | 2/2010 | Bertsch et al. | 134/18 |
| 2010/0043840 | A1 * | 2/2010 | Kim et al. | 134/34 |

* cited by examiner

*Primary Examiner* — Michael Barr
*Assistant Examiner* — Cristi Tate-Sims
(74) *Attorney, Agent, or Firm* — Dority & Manning, P.A.

(57) ABSTRACT

A spray control assembly for a dishwashing appliance is provided. Using concentric flow paths, the spray control assembly allows selection of e.g., the rotational direction for at least one spray arm assembly. The selection of flow through e.g., multiple different spray assemblies is also provided. The spray control assembly incorporates a diverter having multiple port selections.

20 Claims, 12 Drawing Sheets

SPRAY CONTROL ASSEMBLY FOR A DISHWASHING APPLIANCE WITH DIRECTIONAL CONTROL FOR SPRAY ARMS

FIELD OF THE INVENTION

The subject matter of the present disclosure relates generally to a spray control assembly for a dishwashing appliance that allows for selectively switching the direction of rotation of a spray arm assembly.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment.

Conventionally, the lower and mid-level spray assembles are equipped with spray arms and are configured to rotate in only one direction—i.e. clockwise or counter clockwise—but not both. As such, during cleaning operations, articles placed into e.g., a lower rack assembly are sprayed with wash and rinse fluids as the spray arms rotate past the rack in the same direction. Depending upon the orientation of articles, rotation that is fixed in only one direction may limit the ability of a particular pair of spray arms to direct a spray of fluid onto all surfaces of the article—particularly interior surfaces—which in turn can affect the cleaning ability of the appliance. Thus, a dishwashing appliance equipped with a spray arm assembly such as e.g., a lower spray arm assembly that can be caused to rotate in multiple directions (i.e. clockwise and counter clockwise) would be useful.

A dishwashing appliance is typically equipped with at least one pump for circulating fluid through the spray assemblies. However, due to e.g., government regulations on energy and/or water usage, the pump may not be able to supply fluid to all spray assemblies at the same time. A dishwashing appliance that can be configured to selectively control the flow through different spray assemblies would be useful. In addition, such a device that can also provide for selective control over the direction of rotation of a spray arm assembly that can rotate in more than one direction would also be useful.

BRIEF DESCRIPTION OF THE INVENTION

The present invention provides a spray control assembly for a dishwashing appliance. More particularly, the present invention provides a spray control assembly that uses concentric flow paths that can be used e.g., to allow selection of the rotational direction for at least one spray arm assembly. The selection of flow through e.g., multiple different spray assemblies is also provided. Additional aspects and advantages of the invention will be set forth in part in the following description, or may be apparent from the description, or may be learned through practice of the invention.

In one exemplary embodiment, the present invention provides a dishwasher appliance having a tub that defines a wash chamber. A rack assembly is mounted within the wash chamber of the tub and is configured for receipt of articles for washing. A pump provides for a flow of fluid for cleaning the articles. A diverter receives fluid from the pump. The diverter includes a first outlet port and a second outlet port. The diverter is configured for switching between the fluid outlet ports to provide for a fluid flow out of one of the fluid outlet ports at a time. An adapter is connected to the diverter.

The adapter includes a first channel positioned to receive fluid from the first outlet port and has a first channel outlet configured to provide fluid. A second channel is positioned to receive fluid from the second outlet port and has a second channel outlet configured to provide fluid. The first channel outlet and the second channel outlet are concentric and the second channel outlet surrounds the first channel outlet.

In another exemplary embodiment, the present invention provides a spray control assembly for a dishwashing appliance. The spray control assembly includes a rotatable spray arm assembly for positioning in the appliance to provide a fluid spray onto articles for cleaning. A diverter has a diverter inlet for receipt of a fluid flow for supply to the rotatable spray arm assembly. The diverter includes a first outlet port for providing fluid to the rotatable spray arm assembly, and a second outlet port for providing fluid to the rotatable spray arm assembly. The diverter is configured for selectively providing fluid flow to any one of the fluid outlet ports at a time.

For this exemplary embodiment, an adapter is connected to the diverter and in fluid communication with the rotatable spray arm assembly. The adapter includes a first channel connecting a first channel outlet with the first outlet port to provide fluid from the first outlet port through the first channel outlet for supply to the rotatable spray arm assembly. The adapter also includes a second channel connecting a second channel outlet with the second outlet port to provide fluid from the second outlet port through the second channel outlet for supply to the rotatable spray arm assembly. The first channel outlet and the second channel outlet concentric to each other.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 2:
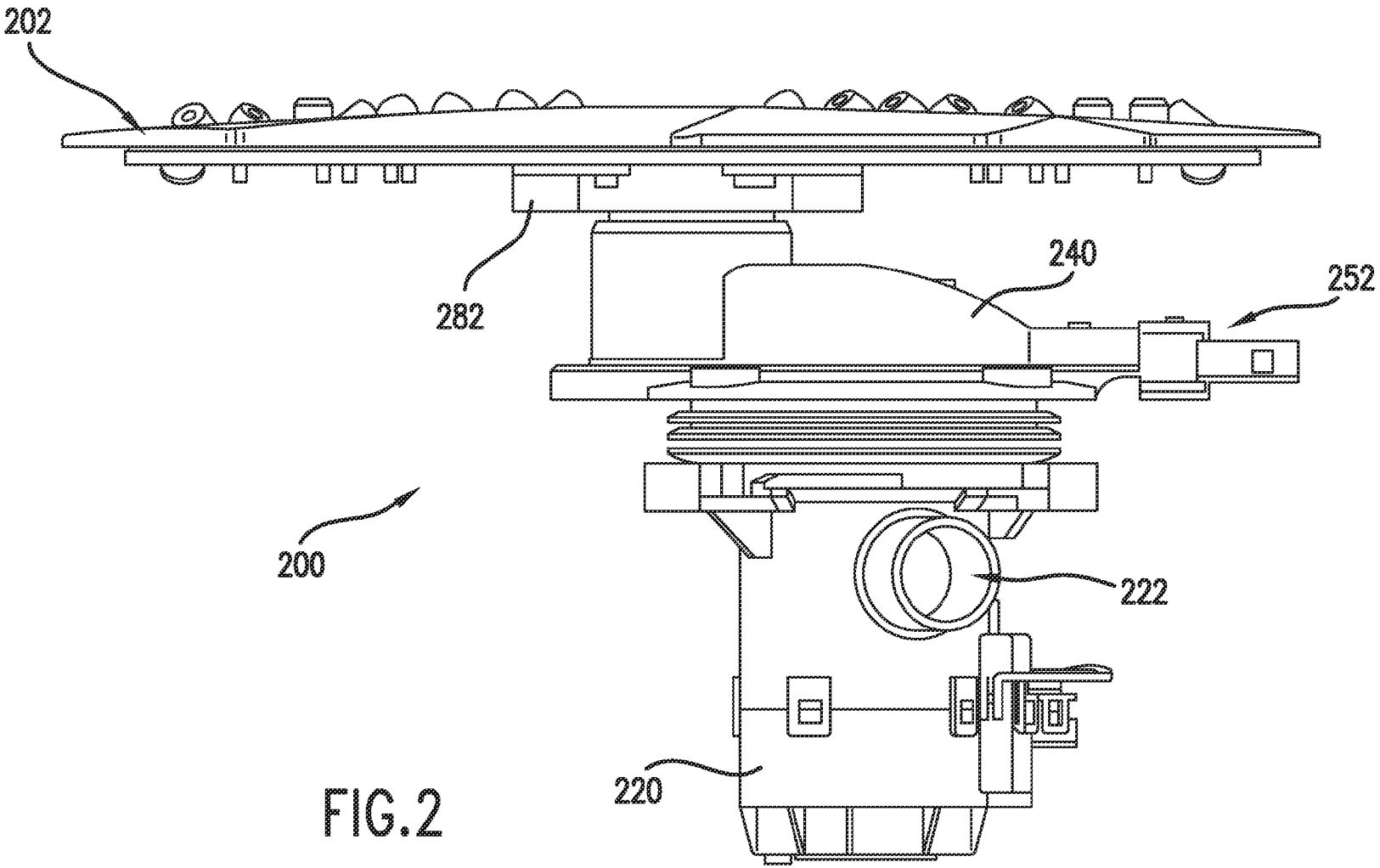
FIG. 2 provides a perspective view of an exemplary embodiment of a spray control assembly of the present invention.
Figure 4:
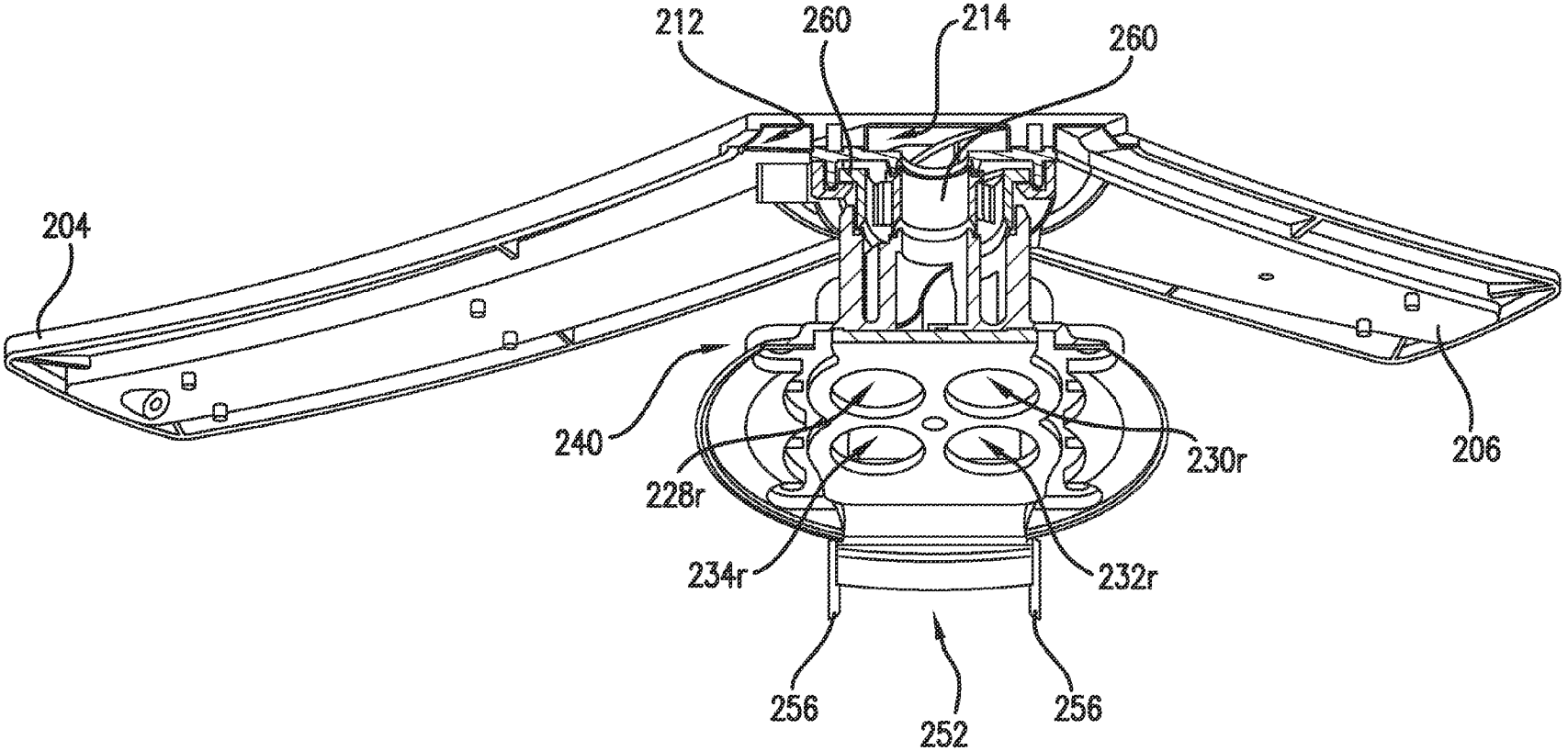

A bottom cross-sectional view of an upper portion of the exemplary spray control assembly of FIG. 2 is provided in FIG. 4. Cross-sections are taken along two different cross-sectional planes.

Figure 5:
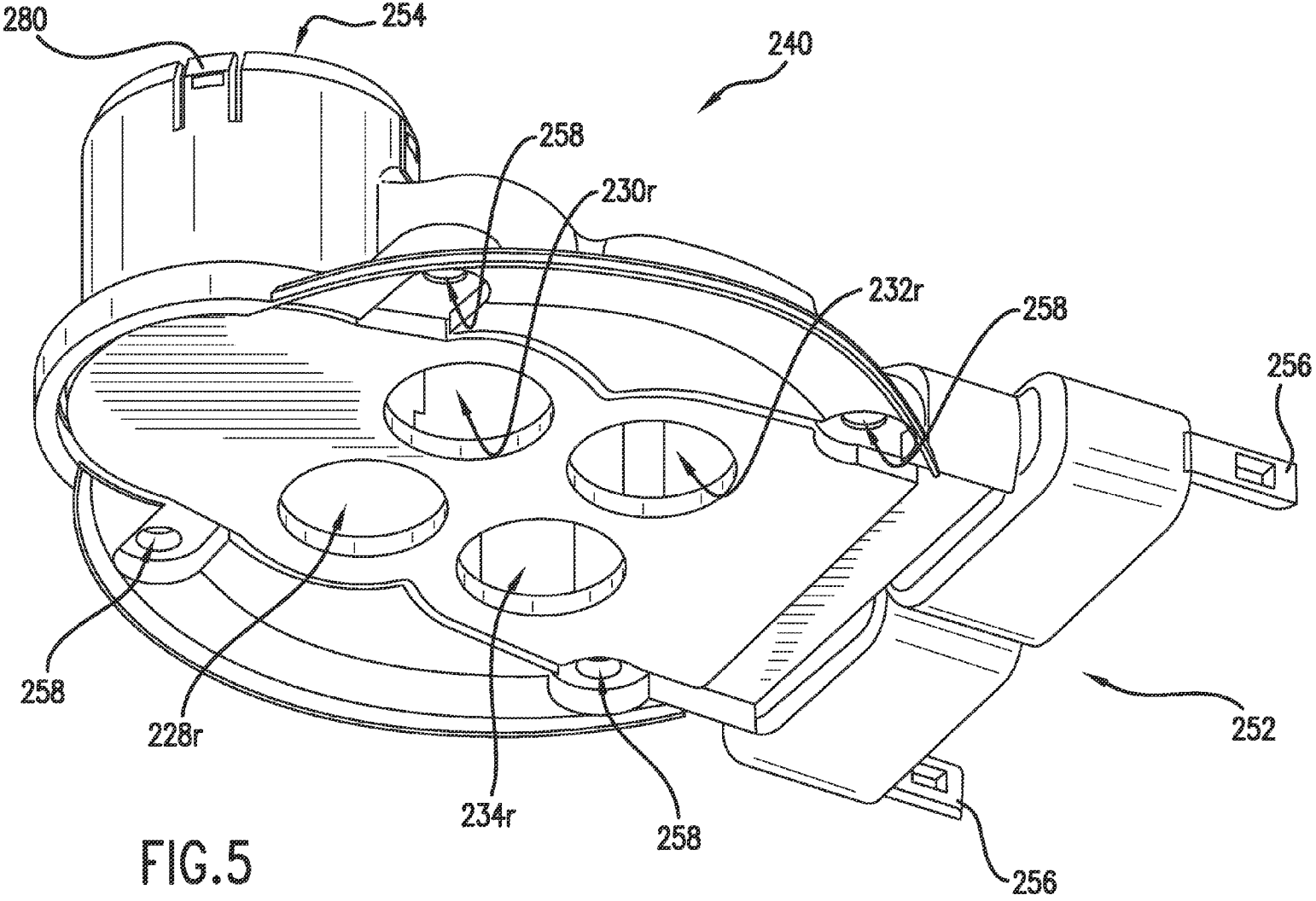

FIG. 5 is a bottom view of a cross-section of an exemplary adapter that is used in the exemplary embodiment of FIG. 2.

Figure 6:
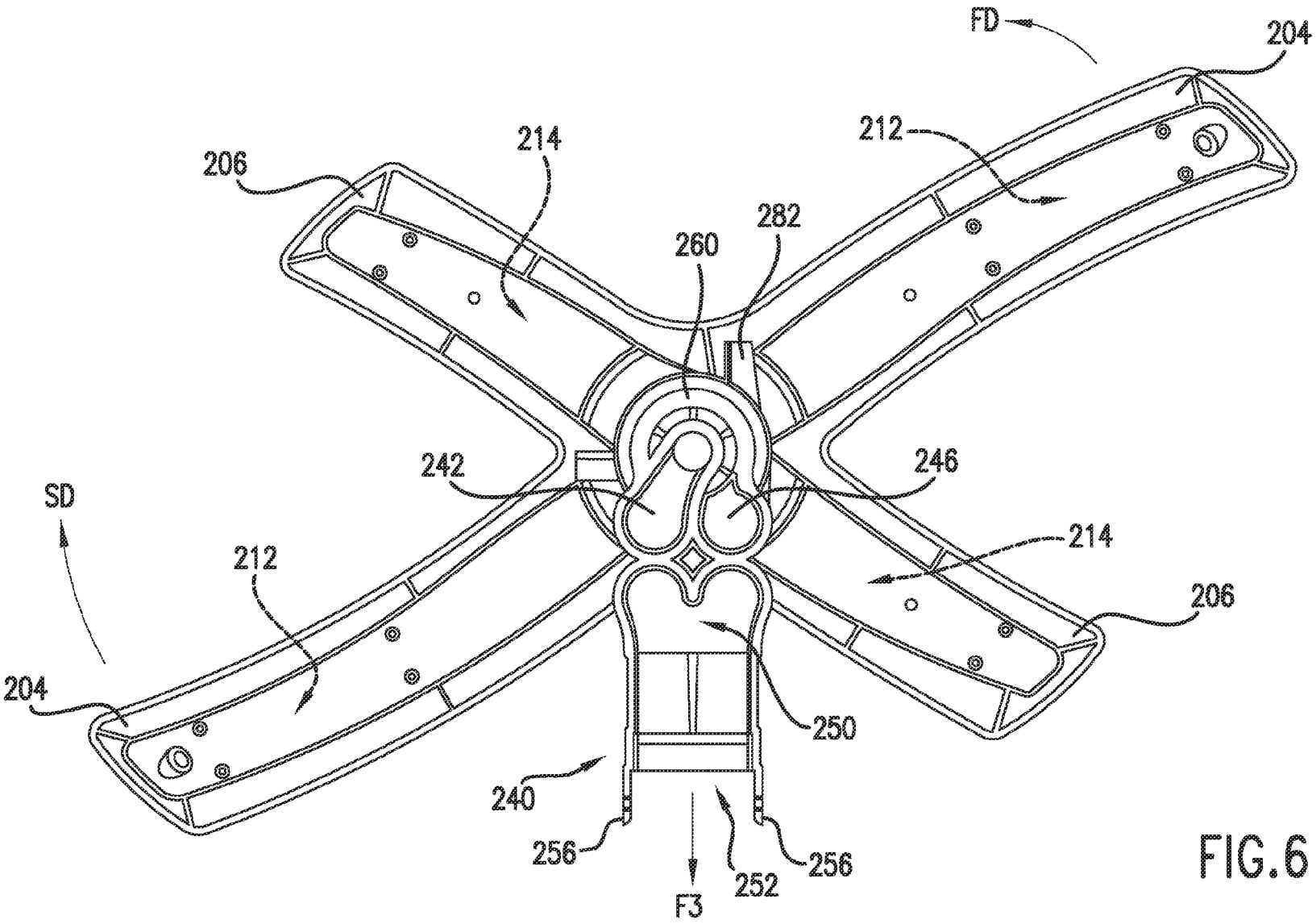

FIG. 6 provides another bottom view of an upper portion of the exemplary spray control assembly of FIG. 2 and at a different perspective than FIG. 4. The cross-section through the adapter is also at a higher position than the cross-section of the adapter shown in FIG. 5.

Figure 7:
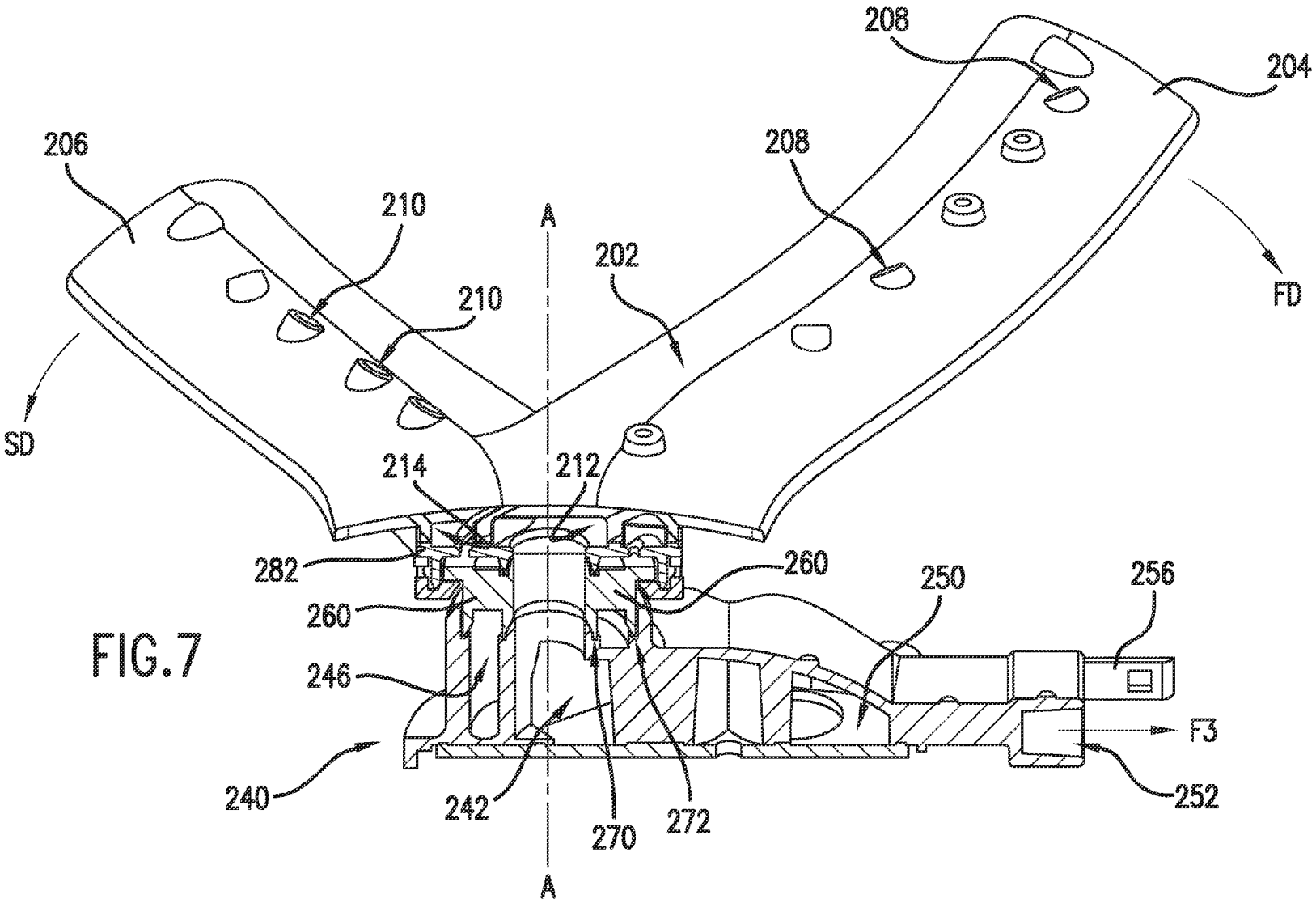

A side cross-sectional view of an upper portion of the exemplary spray control assembly of FIG. 2 is provided in FIG. 7.

Figure 8:
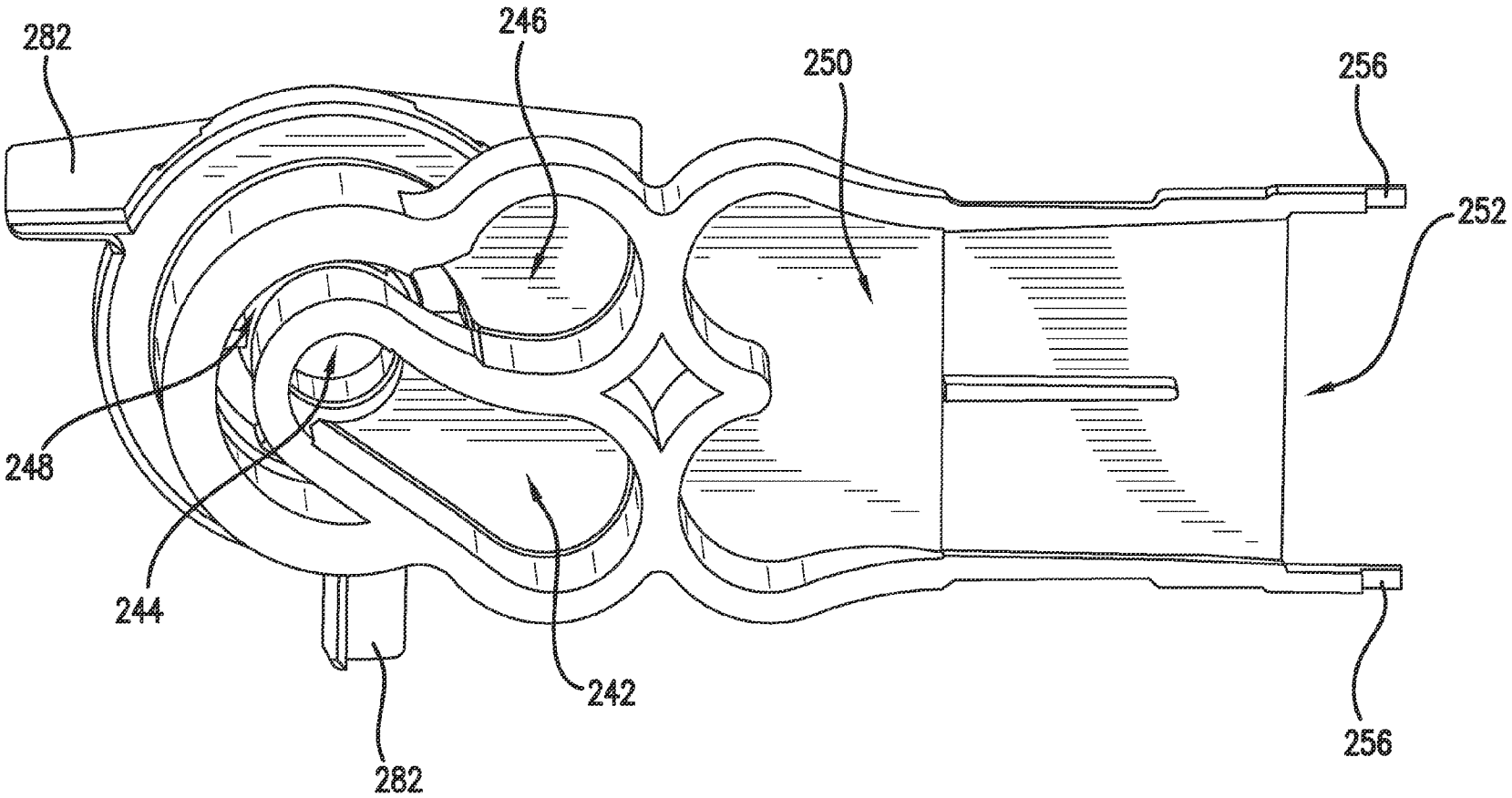

FIG. 8 is a bottom view a cross-section of an exemplary adapter that is used in the exemplary embodiment of FIG. 2.

Figure 9:
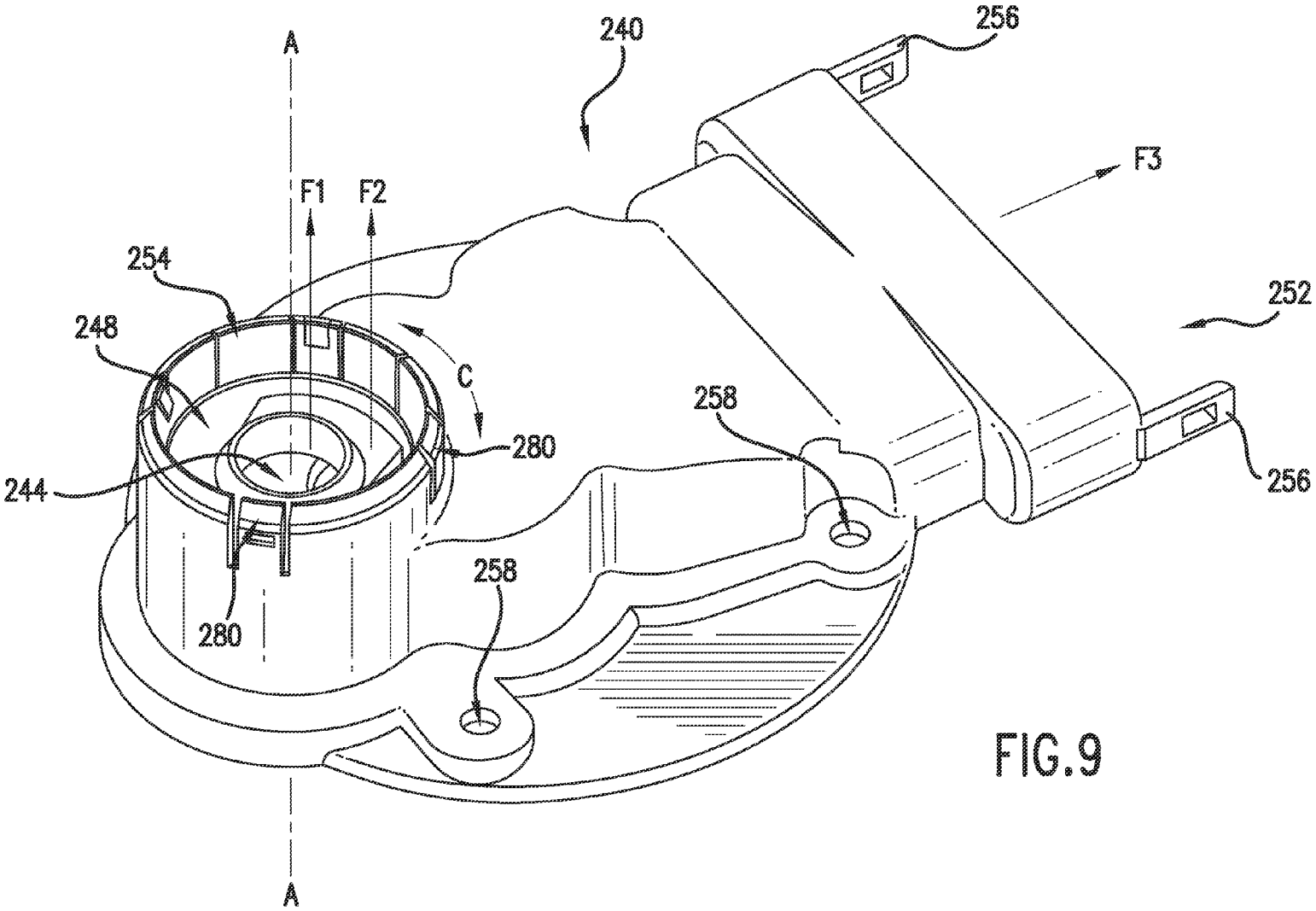

FIG. 9 is a top perspective view of the exemplary adapter of FIG. 2.

Figure 10:
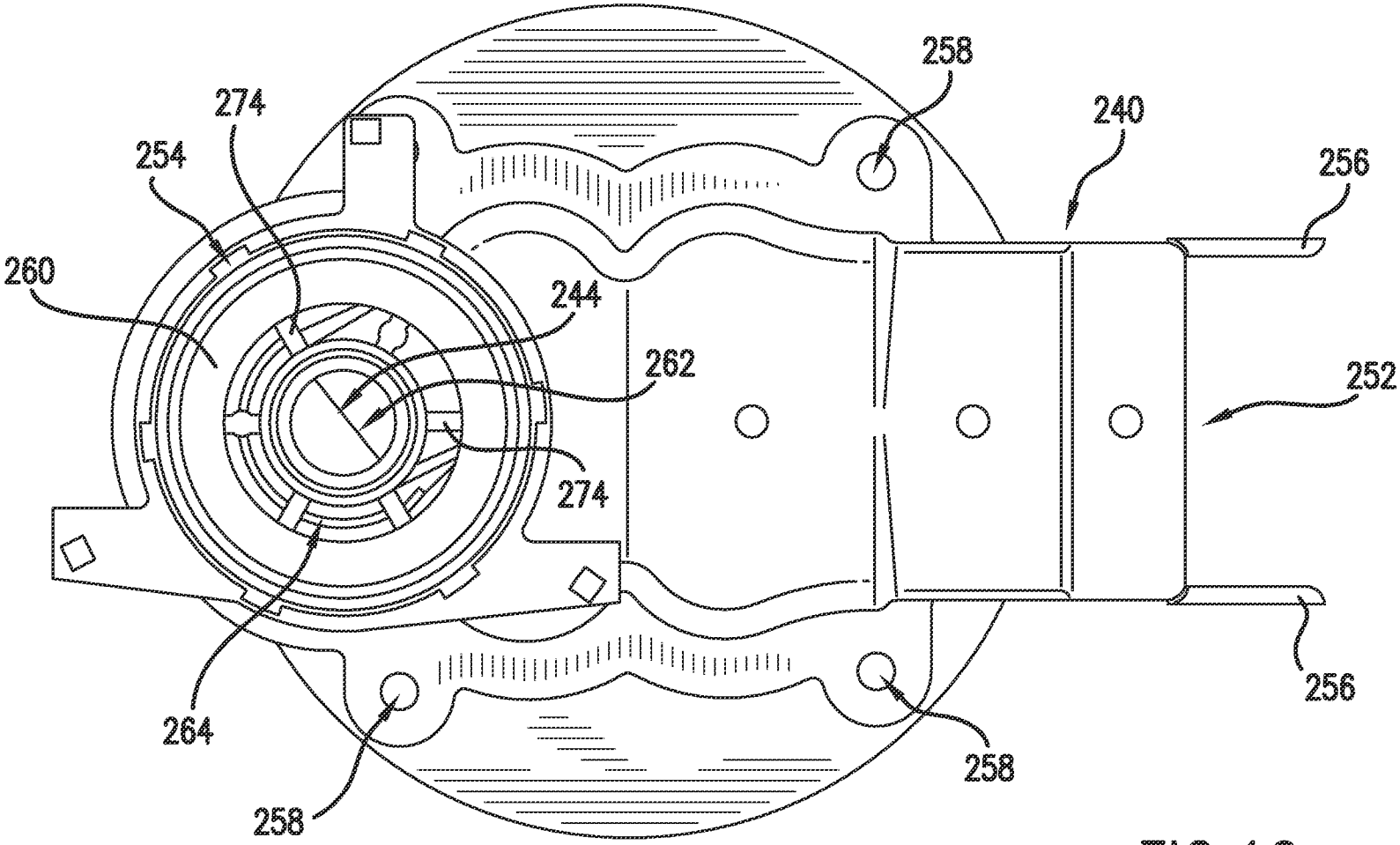

FIG. 10 is a top of the exemplary adapter of FIG. 2.

Figure 11:
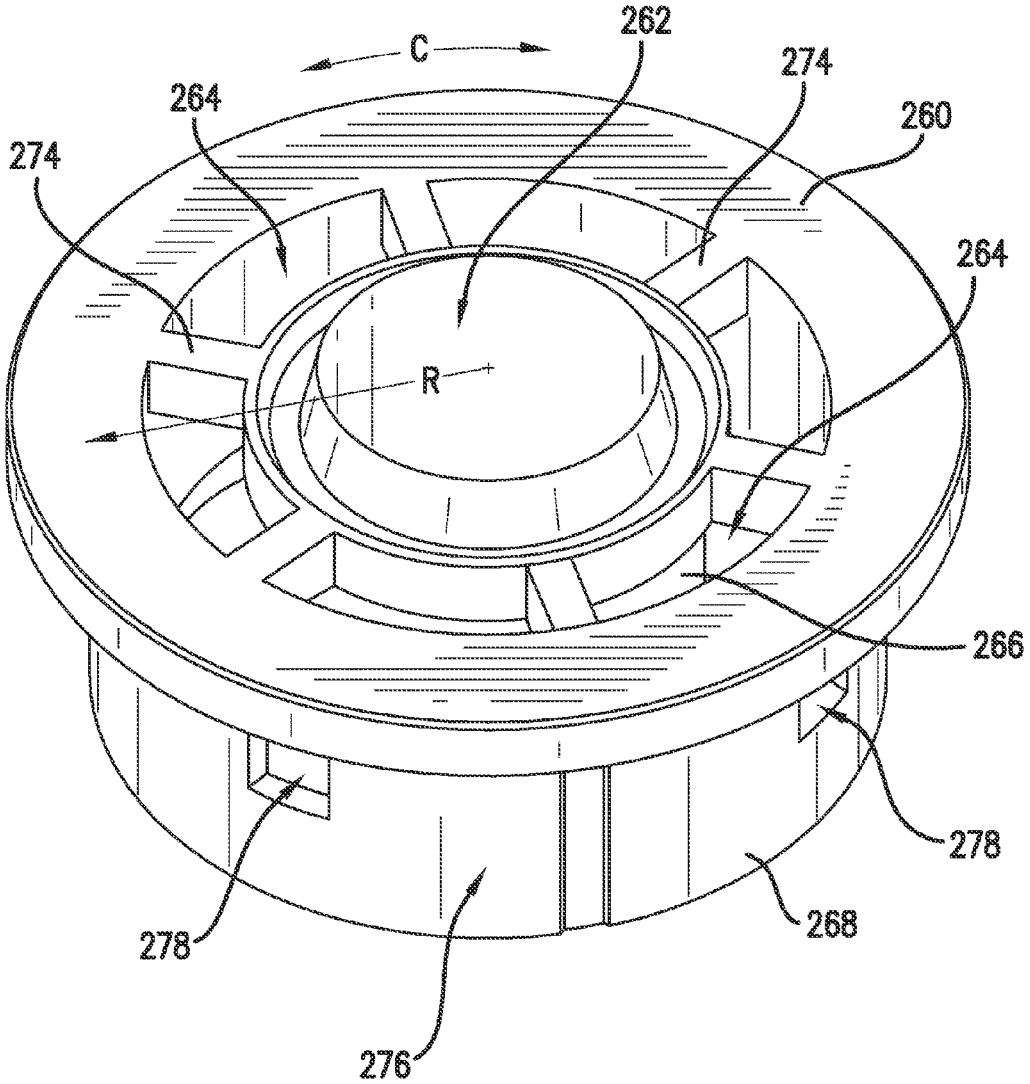

FIG. 11 is a top perspective view of an exemplary bearing as used in the exemplary spray control assembly of FIG. 2.

Figure 12:
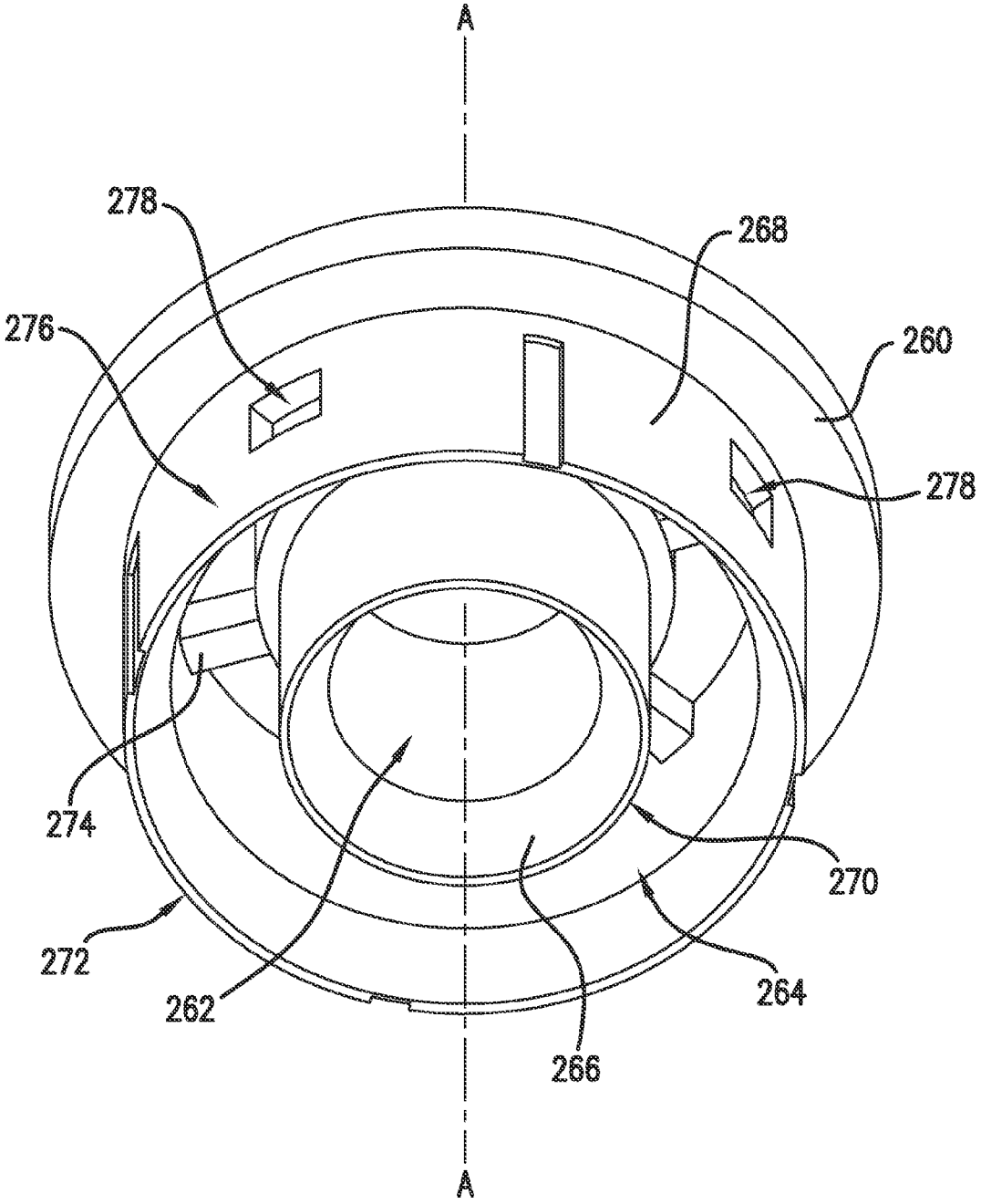

FIG. 12 is a bottom, perspective view of the exemplary bearing as used in the exemplary spray control assembly of FIG. 2.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 1:
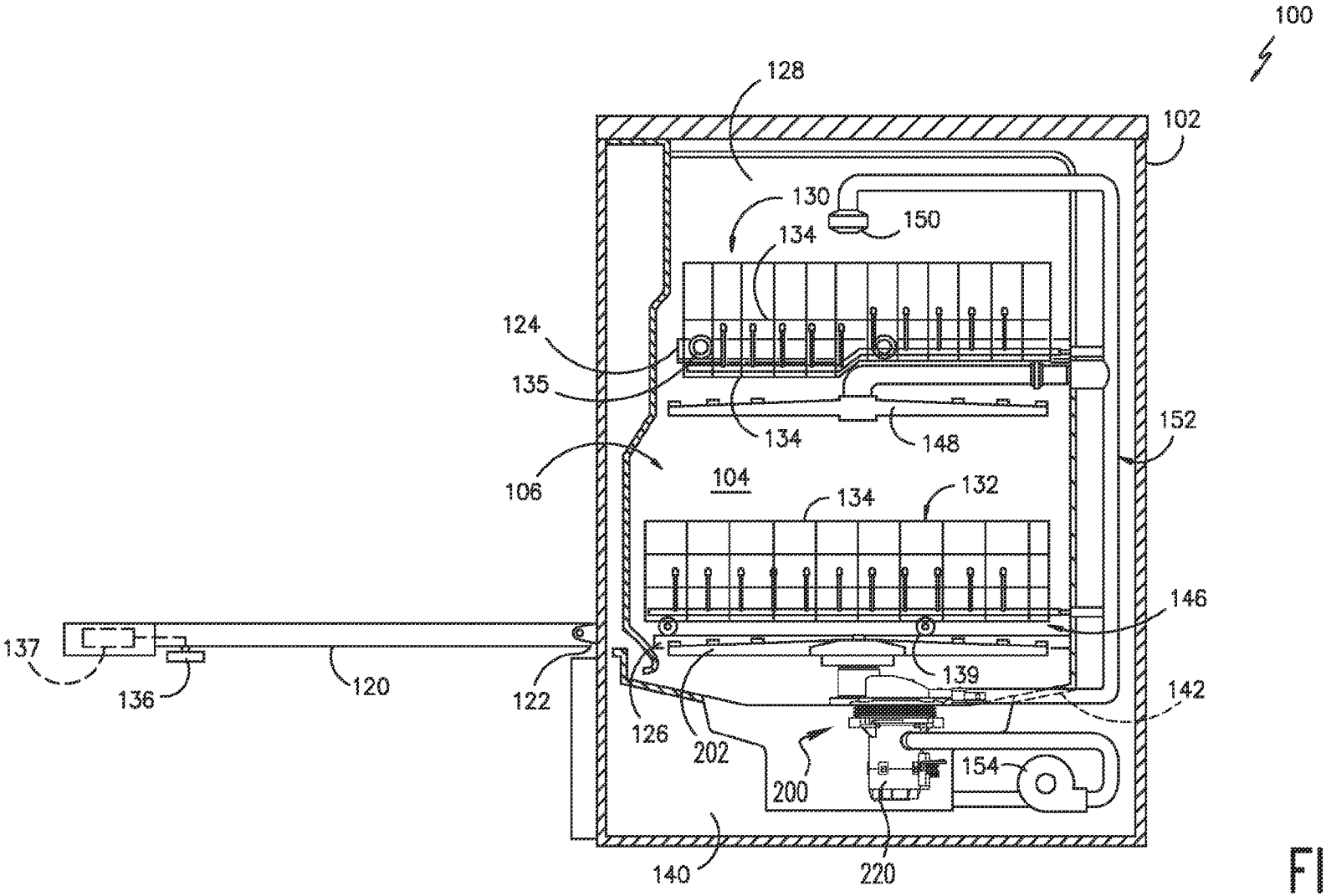
FIG. 1 provides a side cross-sectional view of an exemplary embodiment of a dishwashing appliance as may be used with the present invention.

FIG. 1 depicts a cross-sectional view of an exemplary dishwasher 100 that may be configured in accordance with aspects of the present disclosure. For the particular embodiment of FIG. 1, dishwasher 100 includes a cabinet 102 having a tub 104 therein that defines a wash chamber 106. The tub 104 includes a front opening (not shown) and a door 120 hinged at its bottom 122 for movement between a normally closed vertical position and a horizontal open position that is depicted in FIG. 1. When door 120 is in the closed position, wash chamber 106 is sealed shut for cleaning operations. The horizontal open position in FIG. 1 provides for loading and unloading of articles from dishwasher 100. Such articles may include e.g., pots, pans, plates, silverware, and other utensils. A latch (not shown) is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated from lattice structures including a plurality of elongated members 134 (for clarity of illustration, not all elongated members making up assemblies 130 and 132 are shown in FIG. 1). Each rack 130, 132 is adapted for movement between an extended loading position (not shown) in which the rack is substantially positioned outside the wash chamber 106, and a retracted position (shown in FIG. 1) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a spray control assembly 200 mounted at the bottom of wash chamber 106. Spray control assembly 200 includes a rotatable, lower spray-arm assembly 202 that is rotatably mounted within a lower region 146 of the wash chamber 106 and above a tub sump portion 142 so as to rotate in relatively close proximity to rack assembly 132 and provide fluid spray onto articles in the rack assemblies 130, 132. A mid-level spray-arm assembly 148 is located in an upper region of the wash chamber 106 and may be located in close proximity to upper rack 130. Additionally, an upper spray assembly 150 may be located above the upper rack 130. As shown, upper spray assembly 150 does not include rotating arms. However, other configurations for spray assembly 150 as well as assemblies 148 may be used.

The lower and mid-level spray-arm assemblies 148 and 202 and the upper spray assembly 150 are fed by a fluid circulation assembly 152 for circulating water and dishwasher fluid in the tub 104. The fluid circulation assembly 152 includes a pump 154 located in a machinery compartment 140 that is below the bottom sump portion 142 of the tub 104, as generally recognized in the art. Each spray-arm assembly 148 and 202 includes an arrangement of discharge ports or orifices for directing washing liquid onto dishes or other articles located in rack assemblies 130 and 132. The arrangement of the discharge ports in spray-arm assemblies 148 and 202 provides rotational force by virtue of washing fluid flowing through the discharge ports. The resultant rotation of the spray-arm assembles 148 and 202 provides coverage of articles such as e.g., dishes and other dishwasher contents with a washing spray.

The dishwasher 100 is further equipped with a controller 137 to regulate operation of the dishwasher 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 137 may be positioned in a variety of locations throughout dishwasher 100. In the illustrated embodiment, controller 137 may be located within a control panel area (not shown) of door 120. In such an embodiment, input/output ("I/O") signals may be routed between the control system and various operational components of dishwasher 100 along wiring harnesses that may be routed through the bottom 122 of door 120. Typically, controller 137 includes a user interface panel or control 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. User interface 136 may be in communication with controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

FIG. 2 provides a perspective view of an exemplary embodiment of a spray control assembly 200 of the present invention. For this exemplary embodiment, assembly 200 includes a rotatable spray arm assembly 202 for positioning in the wash chamber 106 of appliance 100 to provide a fluid spray onto articles in the rack assemblies as set forth above. A diverter 220 has a diverter inlet 222 for receiving a flow of fluid from pump 154 that is to be supplied to spray arm assembly 202 during cleaning operations. An adapter 240 is connected to diverter 220 and supports rotatable spray arm assembly 202. A connector 282 is used to connect spray arm assembly 202 with adapter 240.

Figure 3:
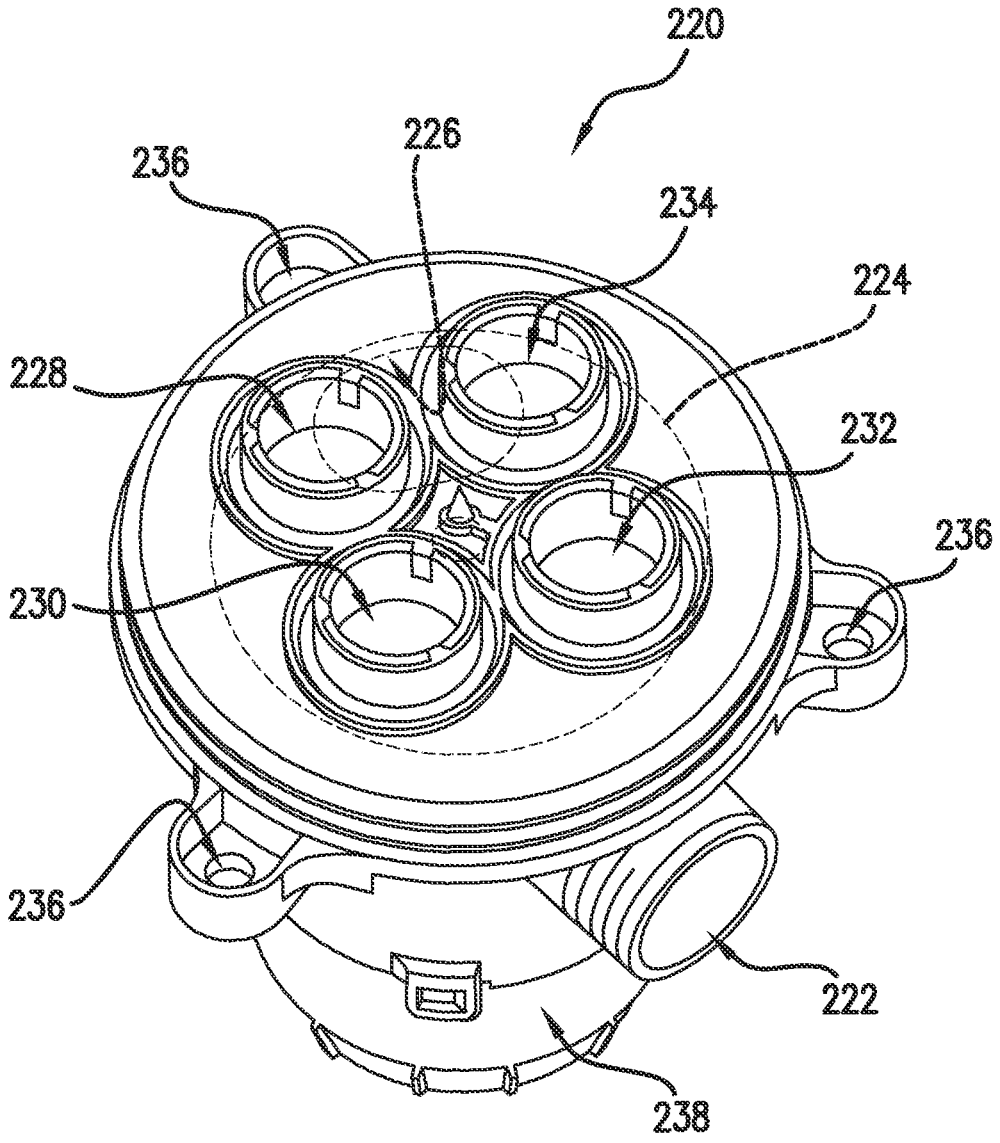
FIG. 3 is a top, perspective view of an exemplary embodiment of a diverter as may be used in the present invention.

A top, perspective view of an exemplary embodiment of diverter 220 is provided in FIG. 3. In this embodiment, diverter 220 includes a first outlet port 228, a second outlet port 230, a third outlet port 232, and a fourth outlet port 234. However, in other embodiments of the invention, two, three, or more than four outlet ports may be used with diverter 220 depending upon e.g., the number of switchable ports desired. Diverter 224 includes a rotatable disk 224 that can be selectively switched between ports 228, 230, 232, and 234 using motor 238. More particularly, disk 224 can be rotated so as to align opening 226 in disk 224 with the port out of which it is desired so as selectively provide fluid flow from pump 154 through any one of the ports 228, 230, 232, and 234. Diverter 224 includes multiple apertures 236 that allow for fastening diverter 224 to the bottom of wash tub 104 (FIG. 1).

As shown in FIGS. 4 and 5, adapter 240 includes ports 228*r*, 230*r*, 232*r*, and 234*r*. Adapter 240 is positioned onto diverter 220 such that ports 228, 230, 232, and 234 align with ports 228*r*, 230*r*, 232*r*, and 234*r*, respectively. Adapter 240 is equipped with multiple apertures 258 that allow for fastening adapter 240 to the tub sump portion 142 of tub 104. (FIG. 1).

With reference to FIGS. 6, 7, 8, and 9 adapter 240 includes a first channel 242 positioned to receive fluid from first outlet port 228 of diverter 220. First channel 242 has a first channel outlet 244 that provides fluid through first channel 242 for delivery to rotatable spray arm assembly 202. A second channel 246 is positioned to receive fluid from second outlet port 230 of diverter 220. Second channel 246 has a second channel outlet 248 that provides fluid through second channel 246 for delivery to rotatable spray arm assembly 202. As best shown in FIG. 9, first channel outlet 244 second channel outlet 248 are concentric to each other about central axis A-A. Additionally, second channel outlet 248 surrounds the first channel outlet 244.

As shown in FIGS. 6 and 8, for this exemplary embodiment, adapter 240 also defines a third channel 250 having a third channel outlet 252. Third channel outlet 252 is connected with fluid circulation assembly 152 for supplying fluid to the mid-level spray arm assembly 148 and upper spray assembly 150. Third channel 252 receives fluid from both the third outlet port 232 and fourth outlet port 234 of diverter 220. Accordingly, motor 238 (acting upon instructions from e.g., controller 137) can positioned opening 226 (FIG. 3) at either port 232 or 234 to provide a fluid flow from pump 154 to assemblies 148 and 150. In other embodiments, of the invention, third channel 252 could be configured into two channels—each connected with one of ports 232 or 234—thereby allowing additional selections to be made for fluid flow using diverter 220.

Continuing with FIGS. 9 and 10, adapter 240 defines a recess 254 in which first channel outlet 244 and second channel outlet 248 are both located. A bearing 260 is received into recess 254. FIGS. 11 and 12 provide additional views of bearing 260. As shown, bearing 260 includes a first cylindrical wall 266 and a second cylindrical wall 268 that are concentric with each other about central axis A-A. First cylindrical wall 266 defines a first flow path 262 that is in fluid communication with first channel outlet 244 of adapter 240. Second cylindrical wall 268 surrounds first cylindrical wall 266 and is spaced apart from wall 266 along radial direction R (FIG. 11) so as to define a second flow path 264 between walls 266 and 268.

A plurality of spokes 274 extend between walls 266 and 268 creating a wagon wheel appearance for bearing 260. The outer surface 276 of second cylindrical wall 268 includes a plurality of apertures 278 spaced apart along circumferential direction C. Apertures 278 receive tabs 280 also spaced circumferentially about recess 254 of adapter 240 so as to fix the position of bearing 260 within recess 254.

Referring to FIG. 7 and FIG. 12, bearing 260 includes a first chamfered edge 270 at the bottom of first cylindrical wall 266 and a second chamfered edge 272 along the bottom of second cylindrical wall 268. Edges 270 and 272 are received onto adapter 240 to provide seals between first flow path 262 and second flow path 264.

As shown in FIGS. 4, 6, and 7, rotatable spray arm assembly 202 includes a first pair of spray arms 204 and a second pair of spray arms 206. First pair of spray arms 204 includes a plurality of fluid outlets or discharge ports 208 to which fluid is fed from first spray arm channel 212. In turn, first spray arm channel 212 is in fluid communication with first fluid channel outlet 244 of adapter 240 through first flow path 262 of bearing 260. Similarly, second pair of spray arms 206 includes a plurality of fluid outlets or discharge ports 210 to which fluid is fed from second spray arm channel 214. In turn, second spray arm channel 214 is in fluid communication with the second channel outlet 248 of adapter 240 through second flow path 264 of bearing 260.

As best shown in FIG. 7, discharge ports 208 of spray arms 204 are oriented in a direction that opposite to the discharge ports 210 of spray arms 206. Accordingly, when fluid exits discharge ports 208, spray arms 204 are caused to rotate in a first direction FD. Conversely, when fluid exits discharge ports 210, spray arms 206 are caused to rotate in a second direction SD that is opposite to first direction FD.

Accordingly, spray assembly 200 allows appliance 100 to provide for different flows of fluid during cleaning operations. More particularly, during operation of dishwashing appliance 100, controller 137 can be configured e.g., to operate motor 238 of diverter 220 to rotate disk 224 and provide flow to either rotatable spray arm assembly 202 or to mid-level spray arm assembly 148 and upper spray assembly 150.

For example, disk 224 is rotated with opening 226 at either third outlet port 232 or 234, then fluid will flow from pump 154 will be fed into third channel 250 where it will flow through adapter 240 and exit (arrow F3 in FIGS. 6 and 7) through third channel outlet 252. From outlet 252, fluid will flow into fluid circulation assembly 152 for supply to the mid-level spray arm assembly 148 and upper spray assembly 150.

As desired during a particular time in the cleaning process, controller 137 can cause motor 238 to position disk 244 such that opening 226 is aligned with first outlet port 228 of diverter 220. As such, fluid flow from pump 154 will be fed into first channel 242 of adapter 240, and then through first channel outlet 244 (flow F1 in FIG. 8) and through first flow path 262 of bearing 260. From first flow path 262, fluid can flow into first spray arm channel 212 so as to cause spray arm assembly 202 to rotate in first direction FD as fluid exits discharge ports 208.

Alternatively, after e.g., a predetermined period of time during the cleaning process, controller 137 can cause motor 238 to position disk 244 such that opening 226 is aligned with second outlet port 230 of diverter 220. As such, fluid flow from pump 154 will be fed into second channel 246 of adapter 240, and then through second channel outlet 248 (flow F2 in FIG. 8) and into second flow path 264 of bearing 260. From second flow path 264, fluid can flow into second spray arm channel 214 so as to cause spray arm assembly 202 to rotate in second direction SD as fluid exits discharge ports 210.

For the exemplary embodiment described above, spray control assembly 200 is shown supplying fluid to a rotatable spray arm assembly. However, as will be understood by one of skill in the art using the teachings disclosed herein, spray control assembly 200 may also be used to control the flow of fluid to other devices as well and is not limited to connection with a spray arm assembly. Additionally, adapter 240 is shown with a first channel outlet and a second channel outlet that are concentric with the second channel outlet surrounding the first channel outlet. As will also be understood by one of skill in the art using the teachings disclosed herein, the present invention is not limited to only two concentric outlets. For example, the adapter could be equipped with three or even more fluid outlets are concentric with each other with e.g., switching therebetween using a diverter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:
- a tub that defines a wash chamber;
- a rack assembly mounted within the wash chamber of the tub and configured for receipt of articles for washing;
- a pump for providing a flow of fluid for cleaning the articles;
- a diverter that receives fluid from the pump, the diverter comprising:
  - a first outlet port;
  - a second outlet port; the diverter configured for switching between the fluid outlet ports to provide for a fluid flow out of one of the fluid outlet ports at a time;
- an adapter connected to the diverter, the adapter comprising:
  - a first channel positioned to receive fluid from the first outlet port and having a first channel outlet; and
  - a second channel positioned to receive fluid from the second outlet port and having a second channel outlet; wherein the first channel outlet and the second channel outlet are concentric and the second channel outlet surrounds the first channel outlet; and
- a bearing connected with a rotatable spray arm assembly and rotatably received within a recess defined by the adapter, the bearing defining:
  - a first cylindrical wall defining a first flow path; and
  - a second cylindrical wall concentric with the first cylindrical wall and surrounding the first cylindrical wall to define a second flow path therebetween,
  - wherein when the bearing is received within the recess, the first cylindrical wall and the second cylindrical wall establish a fluid seal with the adapter, thereby placing the first flow path in fluid communication with the first channel outlet and the second flow path in fluid communication with the second channel outlet.

2. The dishwasher appliance of claim 1, wherein the first flow path and the second flow path are concentric, and wherein the second flow path surrounds the first flow path.

3. The dishwasher appliance of claim 1, wherein the first cylindrical wall defines a first chamfered edge received by the adapter, and wherein the second cylindrical wall defines a second chamfered edge received by the adapter.

4. The dishwasher appliance of claim 1, wherein the first channel outlet and the second channel outlet are located within the recess.

5. The dishwasher appliance of claim 1, wherein the diverter further comprises a third fluid outlet port, wherein the adapter further comprises a third fluid channel positioned to receive fluid from the third fluid outlet port.

6. The dishwasher appliance of claim 5, wherein the adapter further comprises a third fluid channel outlet.

7. The dishwasher appliance of claim 5, further comprising an additional spray arm assembly in fluid communication with the third fluid channel outlet.

8. The dishwasher appliance of claim 1, further comprising:
- a rotatable spray arm assembly positioned near the rack assembly and configured to provide a fluid spray onto articles in the rack assembly;
  - wherein the rotatable spray arm assembly comprises a first pair of spray arms having a first set of discharge ports and being in fluid communication with the first fluid channel outlet and a second pair of spray arms having a second set of discharge ports and being in fluid communication with the second fluid channel outlet, wherein the first set of discharge ports and the second set of discharge ports are oriented in opposite directions, such that the spray arms rotate in a first direction when the diverter is switched to the first fluid outlet port and rotate in a second direction when the diverter is switched to the second fluid outlet port, the first direction being opposite to the second direction.

9. A spray control assembly for a dishwashing appliance, the spray control assembly comprising:
- a rotatable spray arm assembly for positioning in the appliance to provide a fluid spray onto articles for cleaning;
- a diverter having a diverter inlet for receipt of a fluid flow for supply to the rotatable spray arm assembly, the diverter comprising:
  - a first outlet port for providing fluid to the rotatable spray arm assembly;
  - a second outlet port for providing fluid to the rotatable spray arm assembly;
  - wherein the diverter is configured for selectively providing fluid flow to one of the fluid outlet ports at a time;
- an adapter connected to the diverter and in fluid communication with the rotatable spray arm assembly, the adapter comprising:
  - a first channel connecting a first channel outlet with the first outlet port to provide fluid from the first outlet port through the first channel outlet for supply to the rotatable spray arm assembly; and
  - a second channel connecting a second channel outlet with the second outlet port to provide fluid from the second outlet port through the second channel outlet for supply to the rotatable spray arm assembly, the first channel outlet and the second channel outlet concentric to each other; and a bearing connected with the rotatable spray arm assembly and rotatablv received within a recess defined by the adapter, the bearing defining:

a first cylindrical wall defining a first flow path; and a second cylindrical wall concentric with the first cylindrical wall and surrounding the first cylindrical wall to define a second flow path therebetween, wherein when the bearing is received within the recess, the first cylindrical wall and the second cylindrical wall establish a fluid seal with the adapter, thereby placing the first flow path in fluid communication with the first channel outlet and the second flow path in fluid communication with the second channel outlet.

10. The spray arm assembly of claim 9, wherein the rotatable spray arm assembly comprises a first pair of spray arms having a first set of discharge ports and being in fluid communication with the first channel outlet and a second pair of spray arms having a second set of discharge ports and being in fluid communication with the second channel outlet, wherein the first set of discharge ports and the second set of discharge ports are oriented in opposite directions, such that the spray arms rotate in a first direction when the diverter is switched to the first outlet port and rotate in a second direction when the diverter is switched to the second outlet port, the first direction being opposite to the second direction.

11. The spray arm assembly of claim 9, wherein the first flow path and the second flow path are concentric, and wherein the second flow path surrounds the first flow path.

12. The dishwasher appliance of claim 9, wherein the first cylindrical wall defines a first chamfered edge received by the adapter, wherein the second cylindrical wall defines a second chamfered edge received by the adapter.

13. The dishwasher appliance of claim 9, wherein the diverter further comprises a third fluid outlet port, wherein the adapter further comprises a third fluid channel positioned to receive fluid from the third fluid outlet port.

14. The dishwasher appliance of claim 1, wherein the diverter comprises a disk that is selectively rotatable between the outlet ports.

15. The dishwasher appliance of claim 1, wherein a plurality of spokes extend between the first cylindrical wall and the second cylindrical wall.

16. The spray control assembly of claim 9, wherein a plurality of spokes extend between the first cylindrical wall and the second cylindrical wall.

17. The dishwasher appliance of claim 1, wherein the first cylindrical wall and the second cylindrical wall are contained entirely within the bearing.

18. The spray control assembly of claim 9, wherein the first cylindrical wall and the second cylindrical wall are contained entirely within the bearing.

19. The dishwasher appliance of claim 1, further comprising a connector configured to connect the rotatable spray arm assembly with the adapter.

20. The spray control assembly of claim 9, further comprising a connector configured to connect the rotatable spray arm assembly with the adapter.

* * * * *